United States Patent [19]

Debs

[11] Patent Number: 4,886,102

[45] Date of Patent: Dec. 12, 1989

[54] VENETIAN BLIND

[76] Inventor: Victor Debs, 103 St. Marks Pl., Staten Island, N.Y. 10301.

[21] Appl. No.: 225,222

[22] Filed: Jul. 28, 1988

[51] Int. Cl.[4] ..... E06B 9/38

[52] U.S. Cl. ..... 160/177; 160/178.1; 160/168.1

[58] Field of Search ..... 160/168.1, 176.1, 902, 160/107, 178.1, 177

[56] References Cited

U.S. PATENT DOCUMENTS

| | | | |
|---|---|---|---|
| 2,165,292 | 7/1939 | Morse et al. | 160/176.1 X |
| 2,570,455 | 10/1951 | Junkunc | 160/178.1 |
| 2,748,853 | 6/1956 | Beck | 160/176.1 X |
| 2,876,834 | 3/1959 | Walker | 160/168.1 |
| 3,605,852 | 9/1971 | Vecchiarelli | 160/176.1 X |
| 4,327,797 | 5/1982 | Nakajima et al. | 160/168.1 |
| 4,487,243 | 12/1984 | Debs | 160/176.1 X |
| 4,643,238 | 2/1987 | Tachikawa et al. | 160/168.1 |
| 4,673,018 | 6/1987 | Judkins | 160/168.1 X |
| 4,699,196 | 10/1987 | Elliott | 160/168.1 |
| 4,762,161 | 8/1988 | Anderson | 160/168.1 X |
| 4,791,703 | 12/1988 | Chang | 160/176.1 X |

FOREIGN PATENT DOCUMENTS

| | | | |
|---|---|---|---|
| 259843 | 2/1968 | Austria | 160/168.1 |
| 580781 | 8/1959 | Canada | 160/178.1 |
| 179606 | 6/1962 | Sweden | 160/168.1 |

*Primary Examiner*—Ramon S. Britts
*Assistant Examiner*—David G. Kolman
*Attorney, Agent, or Firm*—Amster, Rothstein & Ebenstein

[57] ABSTRACT

A venetian blind has a plurality of slats, a head, brackets for mounting the head on a support, ladder assemblies for suspending the slats from the head, cables provided in the head for lifting and lowering the slats, and cables provided in the head for tilting the slats from essentially horizontal positions to tilted positions and vice-versa. The head has a top and no bottom intermediate the top and the slats.

18 Claims, 3 Drawing Sheets

VENETIAN BLIND

BACKGROUND OF THE INVENTION

The present invention relates to a venetian blind and, more particularly, to a venetian blind having a novel head and/or a novel bottom rail.

A venetian blind conventionally comprises a plurality of slats, a head, brackets for mounting the head on a ceiling, and various pieces of hardware provided in the head for suspending the slats from the head, for lifting and lowering the slats, and for tilting the slats from an essentially horizontal positions to tilted positions and vice-versa. The head is U-shaped, open at the top to receive all the necessary hardware. In order to enable the hardware to be secured within the head, the bottom of the head is provided with openings, holes, tabs, etc. In any case, no matter how the hardware is secured to the head, the bottom of the head is necessarily provided with openings, holes, apertures and the like in order to enable the hardware within the head to operatively communicate with the components of the hardware without the head. For example, the bottom of the head must be provided with apertures through which pass the cables for suspending the slats from the head and for tilting the slats, the cables for lifting and lowering the slats, and the central cable or rods which extend from the head outwardly to where they may be suitably manipulated for lifting and lowering or tilting the slats. In those instances where the head has a top as well, the top performs no function except to shield the hardware within the head from dust, dirt and the like.

In particular instances the apertures required in the bottom of the head may extend into the front of the head or apertures in the front channel holes may replace some of the apertures in the bottom channel. In any event, the apertures are individually formed in separate punching operations made by a series of machines into which the head is inserted consecutively. This is a time-consuming and expensive process requiring costly aperture drilling apparatus capable of forming apertures in roll formed steel, extruded aluminum, polyvinyl chloride or the like.

The suspending means, lifting and lowering means and tilting means are secured at their bottom ends to a bottom rail. The bottom rail is typically of hollow design, provided with opposed upper and lower faces. At least one of these faces is apertured in a manner similar to the head through the same time-consuming and expensive aperture-forming procedures using costly aperture drilling equipment.

Thus the formation of the head and bottom rail of a venetian blind is a time-consuming operation requiring the use of much costly equipment, thereby adding substantially to the final cost of a venetian blind.

Accordingly, it is an object of the present invention to provide a venetian blind in which the head requires no aperture-forming operations.

Another object to provide a venetian blind in which the bottom rail requires no aperture-forming operations.

A further object is to provide a venetian blind in which both the head and bottom rail are imperforate.

It is also an object to provide such a venetian blind which is of relatively low cost.

SUMMARY OF THE INVENTION

It has now been found that the above and related objects of the present invention may be obtained in a venetian blind utilizing a novel head. The venetian blind has a plurality of slats, a head, means for mounting the head on a support, means provided in the head for suspending the slats from the head, means provided in the head for lifting and lowering the slats, and means provided in the head for tilting the slats from essentially horizontal positions to tilted positions and vice-versa. The novel blind has a head characterized by a top, and the absence of a bottom intermediate the top and the slats. The head is preferably imperforate.

The head may be planar or have at least one side depending from the top. In the latter instance, where the head is U-shaped, it includes the top and a horizontally spaced pair of the sides, the top connecting the sides. Where the head is L-shaped, it includes the top and only a single one of the sides.

The head is configured and dimensioned to receive therein at least an uppermost edge of the uppermost of the plurality of slats, thereby precluding any light gap intermediate the head and the plurality of slats.

In a preferred embodiment, at each end of the head, an end cap is mounted on the head end. The lifting and lowering means and the tilting means are at least partially disposed within respective ones of the end caps, the end caps being removably snap-fit into the head. The venetian blind additionally includes first means for actuating the lifting and lowering means and second means for actuating the tilting means, the first and second actuating means being disposed at least partially without the head and partially within the end caps.

In another preferred embodiment the venetian blind includes a plurality of cradles disposed within the head. The cradles are originally slidable into the head and at least partially provide in the head the suspending means, the lifting and lowering means, and the tilting means. The suspending means, the lifting and lowering means, and the tilting means are each secured to at least one of the cradles and at least partially disposed in cradles intermediate the top of the head and the plurality of slats.

The present invention further encompasses a venetian blind having a bottom rail disposed below the plurality of slats and operably engaging the suspending means, the tilting means and the lifting and lowering means, the novel bottom rail being imperforate. In a preferred embodiment the venetian blind additionally includes a clip to receive and engage the bottom ends of the suspending means, the lifting and lowering means, and the tilting means. The clip may be an external wrap-around clip configured and dimensioned to receive and engage the periphery of the bottom rail for movement therewith as a unit. Alternatively, where the bottom rail is hollow, defines an open longitudinal channel, and is configured and dimensioned to receive therein the clip and engage it for movement therewith as a unit, the clip may be an internal clip configured and dimensioned to be received within the hollow of the bottom rail with the suspending means, the lifting and lowering means and the tilting means extending upwardly through the open longitudinal channel.

The present invention further encompasses a venetian blind wherein both the head and the bottom rail are imperforate. The head has a top and no bottom intermediate the top and the slots. Clip means secure one end of the suspending means, the lifting and lowering means, and the tilting means to the bottom rail.

BRIEF DESCRIPTION OF THE DRAWING

The above brief description, as well as further objects and features of the present invention, will be more fully understood by reference to the following detailed description of the presently preferred, albeit illustrative, embodiments of the present invention, when taken in conjunction with the accompanying drawing wherein.

DETAILED DESCRIPTION OF THE PREFERRED EMBODIMENTS

Figure 1:
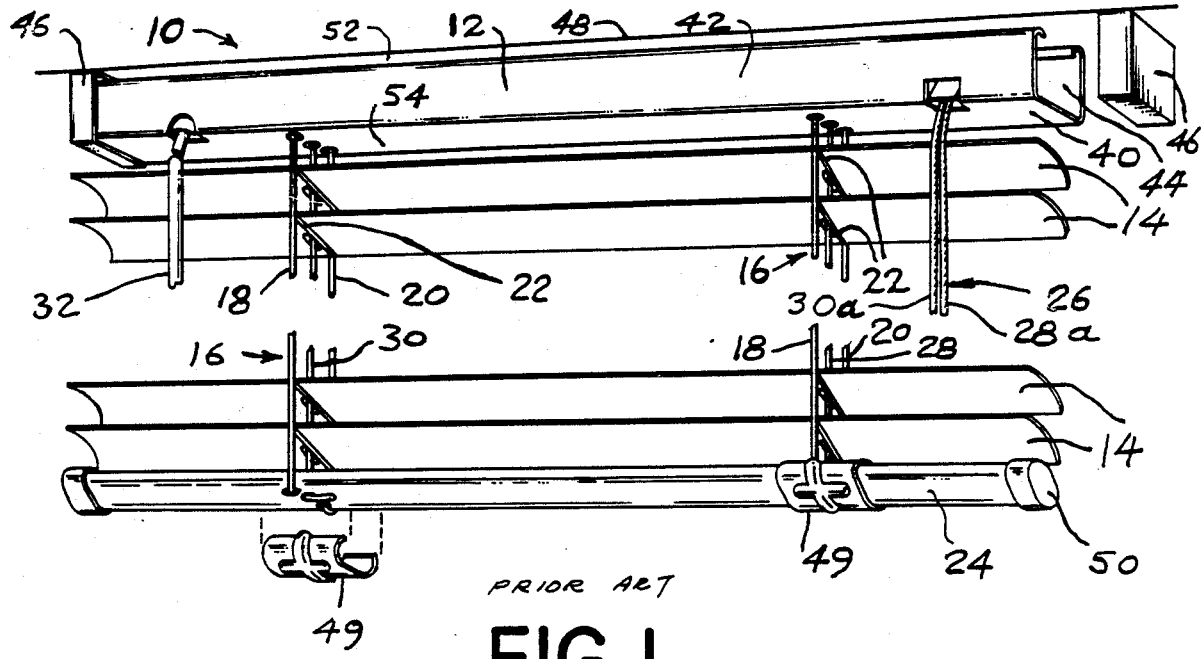
PRIOR ART FIG. 1
FIG. 1 is a fragmentary isometric view of a venetian blind according to the prior art, shown mounted on a ceiling by installation brackets.

Referring now to the drawing, and in particular to FIG. 1 thereof, therein illustrated is a prior art venetian blind, generally designated by the reference numeral 10. The venetian blind 10 comprises a venetian blind head 12 from which are suspended a large number of slats 14 by means of ladder assemblies generally designated 16. Each ladder assembly 16 has a front tape 18, a rear tape 20 and a plurality of tape rungs 22 connecting the front and rear tapes 18, 20, one above each slat 14 and one below each slat 14. The lower ends of the ladder assembly tapes 18 and 20 are connected to a bottom rail 24.

Disposed within the head 12 are means for lifting and lowering the bottom rail 24 and thereby slats 14 one by one, the lifting and lowering means comprising a lift cord generally designated 26 and including a first strand 28 and a second strand 30. The head 12 additionally includes a conventional locking mechanism (not shown) for locking the lift cord 26 in various positions so that the bottom rail 24 may be maintained in any given desired position. Furthermore, the venetian blind includes means 32 for rotating a tilt rod (not shown) on which are mounted tape drums having connected thereto and wound thereabout the upper ends of the ladder assemblies 16. Rotation of the tilt rod in one direction or the other about its longitudinal axis will cause the ladder assemblies 16 to be tilted, whereby the slats 14 are moved from an open position shown in FIG. 1 to tilted positions closing the venetian blinds to varying degrees, and vice-versa. It will be appreciated that these ladder assemblies 16 play a role both in the means for suspending the slats from the head and in the means for tilting the slats.

The lifting and lowering means 26 is actuated by cord strands **28*a* and 30*a*, functional extensions of cords 28 and 30, respectively, which project downwardly out of the head 12. The ladder assemblies 16 are actuated (that is, oriented) by a tilt wand 32, or equivalent means such as tilt ropes, which depend from the head 12** and are connected to the tilt rod by means of various conventional rotatable shafts, tilters and the like.

As is conventional, the venetian blind head 12 is U-shaped in cross-section and includes a bottom 40, a front side wall 42 and a rear side wall 44, the top of the head 12 being open. The head 12 is adapted to be slid into installation brackets 46 open at the rear thereof to receive the head 12 and secured at the top thereof to the ceiling 48 (the right bracket 46 being illustrated as spaced from the blind head 12 solely for illustrative purposes). It will be appreciated that the blind head 12, and in particular the bottom 40 and optionally the front side wall 42 thereof, contains no fewer than eight apertures, three associated with each of the ladder assemblies 16 (for the tapes 18, 20 and cords 28 or 30), one for the actuating means 26 of the lifting and lowering means, and one for the actuating means 32 of the tilt mechanism.

The bottom rail 24 is apertured to receive therewithin the lower ends of the ladder assemblies 16 (for the tapes 18, 20 as well as the lifting and lowering cords 28 and 30). The bottom rail is provided with snap-fit covering elements 49 which conceal the locus of interaction of the bottom rail 24 with the tapes 18, 20 and cords 28 and 30, and may additionally play a role in securing such tapes and cords to the bottom rail. The ends of the bottom rail 24 are typically concealed by end caps 50.

It will be appreciated that there are various gaps adjacent the head 12: a first gap 52 intermediate the top of the head 12 and the bottom of the ceiling 48 or other support to which the installation brackets 46 are secured, and a second gap 54 intermediate the base 40 of the head 12 and the uppermost slat 14 when the slats 14 are in a horizontal orientation. The upper gap 52 facilitates insertion of the head 12 into the installation brackets 46, while the second gap 54 provides room for movement of the uppermost slat from the horizontal orientation to a more tilted orientation. Although the gap 52 is typically not of great height and although the gap 54 may be substantially reduced in height by appropriate tilting of the slats 14, the gaps 52, 54 permit the passage of light through and around the blind, thereby defeating a basic purpose of the blind, i.e., to exclude light. The upper gap 52 further encourages the entry of dirt and dust into the head 12 via the open top thereof.

Figure 6:
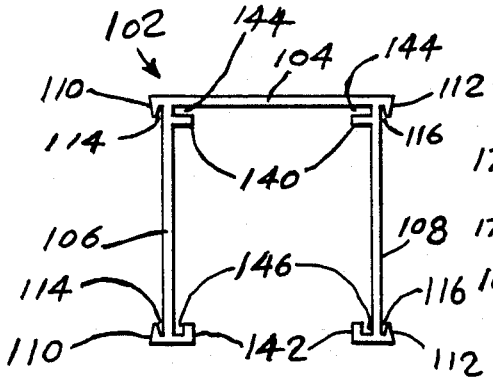
FIG. 6 is an end elevation view of the U-shaped head of the first embodiment of the blind.

Referring now to FIGS. 2 and 4–7, FIG. 2 illustrates a blind according to the first embodiment of the present invention, generally designated by the reference numeral 100. The first embodiment 100 is characterized by an imperforate blind head 102 in the form of an inverted U and defining a top 104 and a horizontally spaced pair of sides 106, 108 depending from the top 104 and connected thereby. Referring now to FIG. 6, therein illustrated is the head 102 standing- alone. It will be appreciated that the head 102 is bilaterally symmetrical so that it may be installed without concern for which end is facing in which direction. In keeping with this philosophy, the top and bottom of the front surface 106 of the front side 106 define a pair of flanges 110 with spaced apart facing free ends, while the top and bottom of the rear surface of the rear side 108 defines a pair of flanges 112 with spaced apart facing free ends. The flange pairs 110, 112 extend the length of the head 102 from one end to the other. The flanges 110, 112 extend generally vertically, parallel to the head sides 106, 108, but spaced slightly outwardly therefrom to define intermediate each flange and the adjacent side 106, 108, respectively, nips or slots 114, 116, respectively. The upper flanges 110, 112 extend generally downwardly, while the lower flanges 110, 112 extend generally upwardly.

Figure 2:
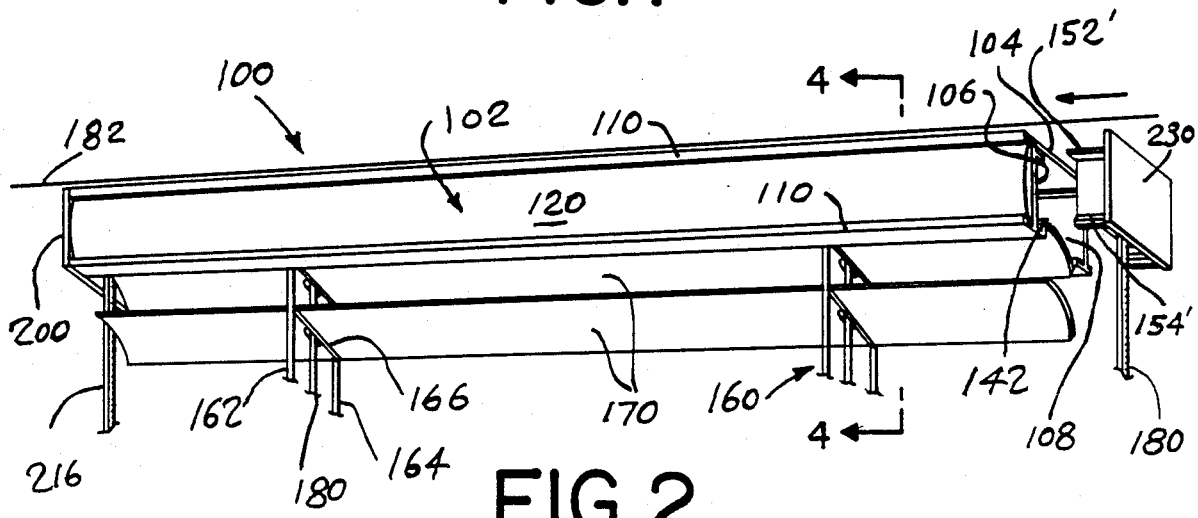
FIG. 2 is a fragmentary isometric view of an upper portion of a venetian blind according to a first embodiment of the present invention having a U-shaped head.
Figure 4:
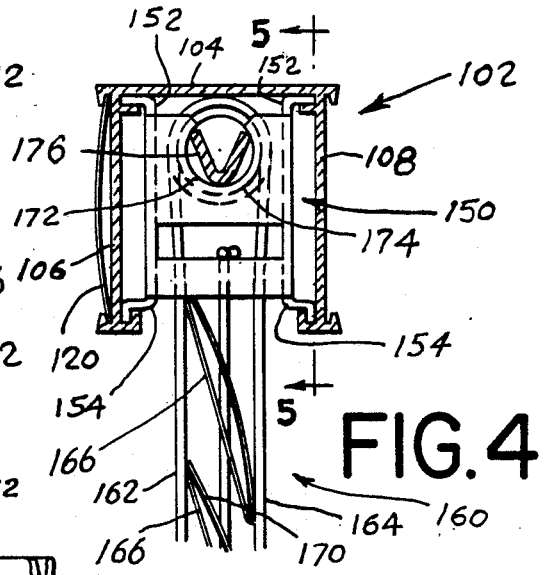
FIG. 4 is an end elevation view of the first embodiment of the blind partially in section, taken along the lines 4—4 of FIG. 2 and looking in the direction of the arrows.

As illustrated in FIGS. 2 and 4, the front nips 114 are adapted to receive the top and bottom edges of a fascia 120 which may be formed of an unapertured slat or a similar resilient structure for aesthetically concealing substantially all of the front face of the head 102. (In the event that what has been here designated as the rear side 108 is facing forwardly—that is, visible to those in the room—the fascia would be received and maintained by the nips 116.) The use of a fascia 120 enables a standard color head 102 to be utilized with slats of varying colors while still creating the impression of a customized head 102 because of the color coordination of the fascia 120 and the slats. In particular applications, however, the front flanges 110 may be dispensed with and the front side 106 of the head 102 given a standard surface treatment to render it compatible visually with the particular slats to be supported therefrom. The nips 114, 116 which are not being used to hold the fascia 120 play a role in mounting of the head 102.

Figure 7:
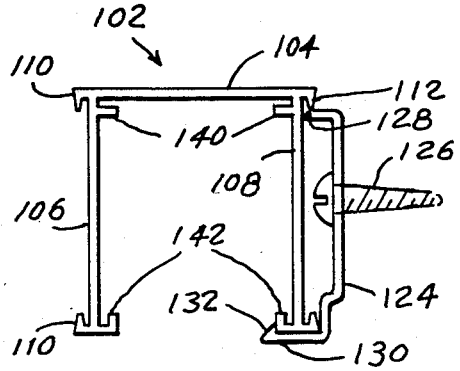
FIG. 7 is a end elevation view of U-shaped head of the first embodiment with a side installation member.

Referring now to FIG. 7, the head 102 is mounted by L-shaped installation members 124 which are secured to a wall of the room or a frame of the window by fasteners 126 such as wood or metal screws. A plurality of the installation members 124 may be disposed along the length of the head 102 as necessary to provide adequate support therefor, taking into consideration the weight of the blind, the strength of the attachment formed by the fastener 126, the wall or window frame space available, etc. Much as in the manner of the top of the fascia 120, the upper end 128 of the vertical portion of mounting member 124 is received in the nip 116 between the top flange 112 and the rear side 108. The vertical portion of the mounting member 124 also bears against the lower flange 112 to resist the counter-clockwise turning moment exerted by the head 102 on the mounting member 124. The horizontal portion 130 of the L-shaped mounting member 124 extends under the rear side 108, and also serves to resist the turning moment. A tab or cutout 132 of the horizontal portion 130 of the mounting member 124 is crimped or frictionally engaged with- the head 102 once the mounting member 124 is in place in order to lock the mounting member 124 to an appropriate point along the length of the head 102, thereby to prevent accidental relative displacement of the head 102 and the mounting member 124.

Clearly, other configurations of the mounting member 124 may be used. It will be appreciated that once the mounting member 124 is secured to the wall or window frame by fastener 126, the nip 116 between the upper flange 112 and the rear panel 108 is slid over the top of the first portion 128 of the mounting member 124, with the bottom of the rear side 108 coming to rest on the horizontal portion 130 of the mounting member 124.

The head 102 additionally includes two upper horizontal carriage-mounting flanges 140, each extending inwardly from one of the sides 106, 108 and being spaced slightly below the top 104, and two lower vertical carriage-mounting flanges 142, each secured to one of the sides 106, 108 inwardly thereof and extending upwardly parallel to the side 106, 108. The upper horizontal flanges 140 define with the top 104 nips or slots 144 to receive upper cradle arms to be explained hereinbelow, just as the lower vertical flanges 142 cooperate with the sides 106, 108 to define nips or slots 146 to receive lower cradle arms to be explained hereinbelow.

Figure 5:
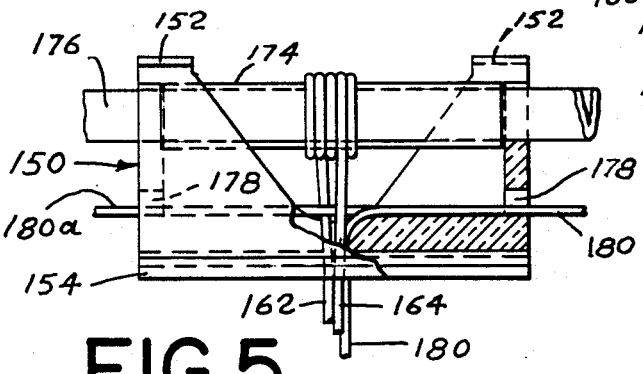
FIG. 5 is a fragmentary rear side elevation view of the cradle and its contents, taken along the line 5—5 of FIG. 4 and looking in the direction of the arrows, with portions of the cradle being cut away to reveal details of internal construction.

Referring now to FIGS. 4 and 5, disposed within the head 102 is a cradle generally designated 150 The cradle has two L-shaped upper arms 152, each of which extends upwardly and then outwardly to fit in the nips or slots 144 defined by the upper horizontal flanges 140 and the head top 104, and two L-shaped lower arms 154 which extend outwardly and then downwardly to be received in the nips or slots 146 defined by the lower vertical flanges 142 and the sides 106, 108. There are a plurality of cradles 150 disposed along the length of the head 102, each cradle 150 being disposed above a conventional ladder assembly 160 comprised of a front tape 162, a rear tape 164, and a plurality of tape rungs 166 connecting the front and rear tapes 162, 164, one above each slat 170 and one below each slat 170. Additionally, the cradle 150 includes a cutout 172 to receive the tape drum 174 mounted on tilt rod 176 for movement therewith. Finally, the cradle 150 further includes a channel 178 enabling passage of the lift cord 180 through the cradle.

It will be appreciated that the use of side mounting member 124 permits the virtual elimination of the customary top gap between the head 102 and the ceiling 182. Similarly, the absence of any bottom to the head 102 enables the uppermost slat 170 to at least partially enter into the head 102, so that, when seen from the front of the blind, it overlaps with the fascia 120 to provide an almost uninterrupted line of slats (or slats and decoratively coordinated fascia material) for the entire height of the blind, without any conventional gap between the bottom of the head and the top of the uppermost slat. The gap between the top of the head and the ceiling may be reduced to a few millimeters, just enough to allow the head to slip over the mounting member. The entry of dirt and dust into the conventional head 12 through this upper gap 52 is not a problem in the present invention as the top of the head 102 is imperforate.

A conventional lift cord lock mechanism and a conventional tilter mechanism may be secured to cradles 150 of the type described in connection with the ladder assemblies 160. However such mechanisms are particularly subject to sudden sharp jerks, either along the longitudinal axis of the head 102 or downwardly in the course of their use. Accordingly, in order to provide better support for these mechanisms than that affordable by the cradle 150, it is an optional feature of the present invention to position these mechanisms within end caps, as illustrated in FIGS. 15–19. A further advantage of the optional construction is that the tilt cord and lift cord are maintained beyond the ends of the slats so that they do not interfere with operation of the slats and the slats do not interfere with their operation. This design was not feasible in the prior art devices which required the ends of the head 12 to be fitted within installation brackets 46 and is made possible in the present invention by the use of side mounting members 124.

Figure 14:
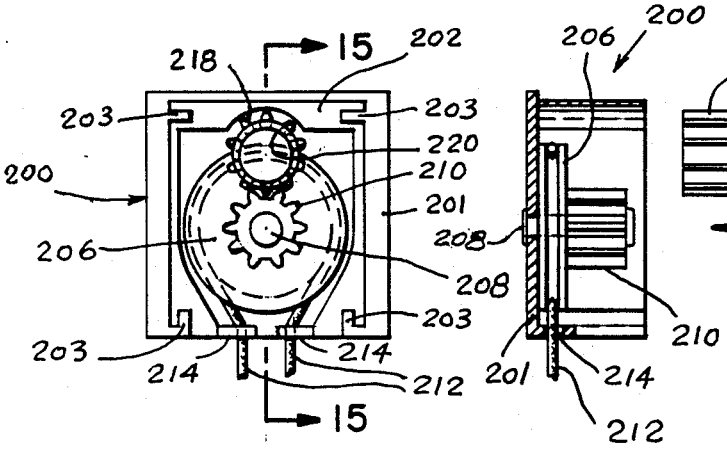
FIG. 14 is a fragmentary end elevation view of the tilter and end cap unit.
Figure 15:
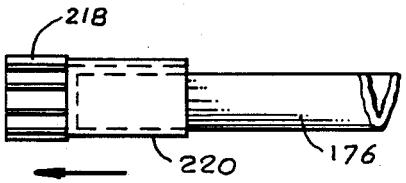
FIG. 15 is an exploded front elevation view of the tilter and end cap unit, taken along the line 15—15 of FIG. 14 and looking in the direction of the arrows.

Referring now to FIGS. 14 and 15, therein illustrated is the end cap unit,.generally designated 200, containing the tilter mechanism. The end cap 200 includes a vertical base plate 201 and a flange 202 which projects inwardly therefrom and complements the inner surface of the head 102. Thus, when the end cap 200 is mounted onto an end of the head 102, the horizontal and vertical carriage-mounting flanges 140, 142 of the head 102 are securely engaged by recesses 203 in the flange 202.

Within the area defined by the flange 202 is a tilter mechanism including a tilt pulley 206 rotatably secured to the end cap 200 by a rivet 208, the tilt pulley 206 including an inwardly projecting gear 210 secured thereto for rotation therewith as a unit. A tilt cord 212 is looped over the top of the tilt pulley 206 for rotating the same clockwise and counter-clockwise. The ends of the tilt cord 212 extend downwardly through respective openings 214 in the bottom wall of the end cap 200. The V-shaped tilt rod 176, which extends through the entire length of the head 102, has at the end adjacent the end cap 200 a gear 218 secured thereto by a friction collar 220. When the end cap 200 is fitted onto the head 102, the tilt rod gear 218 is disposed intermediate the gear 210 of the tilt pulley 206 and the adjacent surface of the flange 202 so that the gears 210, 218 are maintained in meshing engagement. Thus rotation of the tilt pulley 206 by the tilt cord 212 results in a corresponding rotation of the gears 210, 218, and normally a corresponding rotation of the tilt rod 176 and hence the tilt drums 174. However, the friction fitting of the collar 220 on the tilt rod 176 permits slippage of the tilt rod 176 relative to the collar 220 when the blind is already closed so tightly that further movement of the slats 170 is impossible.

Figure 17:
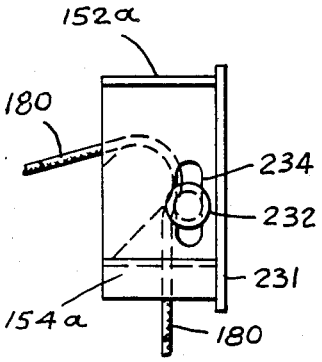
FIG. 17 is a view similar to FIG. 16, but showing the locking mechanism in the locked position.
Figure 16:
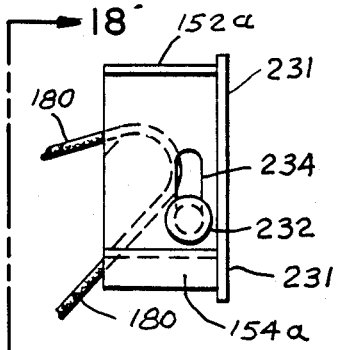
FIG. 16 is a fragmentary front elevation view of the cord lock and end cap unit, showing the locking mechanism in the open position.
Figure 18:
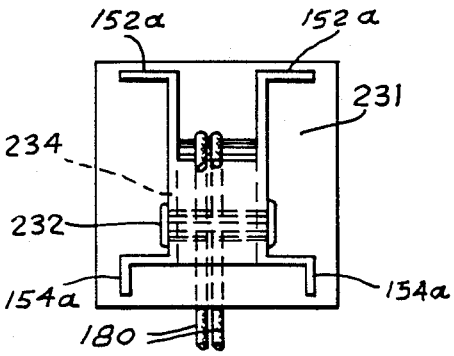
FIG. 18 is an end elevation view of the cord lock and end cap unit, taken along the line 18—18 of FIG. 16 and looking in the direction of the arrows.

Referring now to FIGS. 16–18, therein illustrated is the end cap unit, generally designated 230, containing the lift cord lock mechanism. The end cap unit 230 may include the flange 202 illustrated in connection with end cap unit 200, and this is recommended for applications where the demands on the lock cord mechanism may be severe. Alternatively, as best illustrated in FIG. 18, the end cap unit 230 may have a vertical base plate 231 and inwardly projecting tabs corresponding to the peripheral outline of the cradle 150 and including arms **152*a*, 154*a*. It will be appreciated that in those instances where severe demands on the tilter mechanism are not anticipated, the end cap unit 200 may be provided with tabs 152*a*, 154*a* rather than the flange 202 illustrated in connection therewith in FIGS. 14–15. In any case, the end caps 200, 230 preferably removably snap fit into the respective ends of heads 102**.

The lift cord lock mechanism is of conventional design and includes a locking pin 232 and a vertically-extending channel 234 in which the locking pin 232 floats. The locking pin 234 when disposed at the bottom of the channel 234, as illustrated in FIG. 16, constitutes an open lock mechanism enabling movement of the lift cord 180 thereby. The locking pin 232 when disposed in an elevated position in the channel 234, as shown in FIG. 17, constitutes a closed or locked lock mechanism precluding further movement of the lift cord 180 thereby until the lift cord 180 is moved laterally away to break its engagement with the locking pin 232 and allow the pin 232 to drop.

Figure 13:
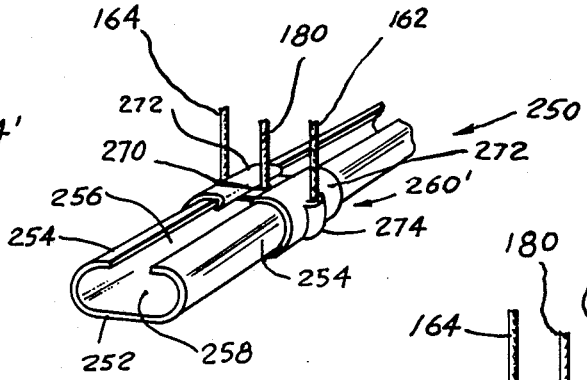
FIG. 13 is a fragmentary isometric view of the bottom rail and an external clip and the members connected thereto.
Figure 12:
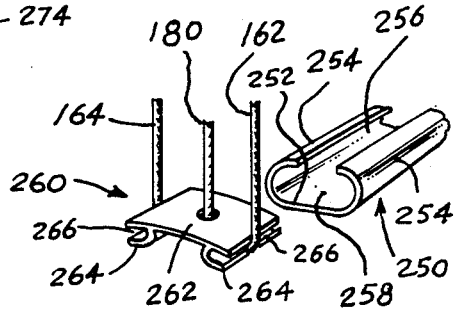
FIG. 12 is a fragmentary exploded isometric view of the bottom rail and an internal clip and the members connected thereto.

Referring now to FIGS. 12 and 13, like the head 102, the novel bottom rail of the present invention, generally designated 250, is imperforate. The bottom rail 250 is somewhat elliptical in cross section, being formed of a generally planar bottom portion 252 and upwardly and inwardly curled front and back side portions 254. The long edges of the curled side portions 254 approach each other, without touching, so as to define therebetween a longitudinally extending upper channel 256 communicating with the hollow or central cavity 258 of the bottom rail 250. The bottom rail 250 is adapted for use with either an internal clip generally designated 260, as illustrated in FIG. 12, or an external clip generally designated 260′ as illustrated in FIG. 13. While the unapertured or imperforate bottom rail 250 extends generally the length of the head 102, each clip 260 or 260′ extends only a short distance along that axis, there being a separate clip 260,260′ for each ladder assembly 160.

Referring now to FIG. 12, each internal clip 260 includes a substantially planar member 262 which is centrally apertured to enable the bottom end of lift cord 180 to be passed downwardly therethrough, the bottom end of lift cord 180 thereafter being knotted so that the clip 260 is liftable with the lift cord 180. The front and back edges of the generally planar member 262 cooperate with lower flanges 264 under each to define channels 266 into which the knotted bottom ends (not shown) of the ladder assembly tapes 162, 164 may be placed. One clip 260 is associated with each ladder assembly 160, and the clips 260 are inserted into the cross-sectional hollow 258 of the bottom rail 250 with the cord 180 and tapes 162, 164 extending upwardly through the open longitudinal channel 256. The clip 260 and bottom rail 250 are cooperatively configured and dimensioned so that the curled side portions 254 of the bottom rail 250 engage and hold the clip 260 for movement therewith as a unit, both up and down in response to activation of lift cord 180 and tilting in response to activation of tapes 162, 164. The curled side portions 254 of the bottom rail 250 assist in maintaining the knotted ends of the tapes 162, 164 within the channels 266 of the clip 260 formed by the planar portion 262 and the lower flanges 264 and also deform the tapes 162, 164 and thereby assist in securing the tapes to the clip.

Referring now to FIG. 13, each external clip 260′ is comprised of a substantially planar member 270 which is centrally apertured to enable passage therethrough of the bottom end of a lift cord 180, which bottom end is thereafter knotted so as to enable lifting of the lift cord 180 and clip 260′ together as a unit. The substantially planar member 270 has downwardly curled front and back side flanges 272 defining interior channels 274 extending transversely to the longitudinal axis of the bottom rail 250. The tapes 162, 164 of the ladder assembly 160 are secured in respective channels 274, which are provided with internal serrations to grasp the tapes 162, 164 once they have been inserted and preclude their withdrawal. The securing of the tapes 162, 164 to the clip 260' by means of the channels 274 enables the clip 260' (and hence the bottom rail 250) to be tilted one way or the other.

Regardless of whether the imperforate bottom rail 250 is used in combination with an internal clip 260 or an external clip 260', a standard bottom rail end cap 50 (see FIG. 1) may be used to provide a more closed appearance for the bottom rail 250. Further, the bottom slat 170 may be disposed closely adjacent the top of the bottom rail 250 to conceal the longitudinal channel 256 thereof. In this manner the appearance of a conventional bottom rail may be obtained using the cheaper imperforate bottom rail of the present invention.

While clearly substantial economies can be achieved through use of either the imperforate head of the present invention, or the imperforate bottom rail of the present invention, even greater economies are achieved through use of both the imperforate head and the imperforate bottom rail in combination.

The present invention further encompasses embodiments of the blind in which the head is L-shaped or planar. In describing these embodiments, elements which both serve the same function as, and have the same structure as, corresponding elements in the first embodiment will be identified by the corresponding number. Elements which serve the same general function but have a different structure will be identified by the corresponding number primed.

Figure 3:
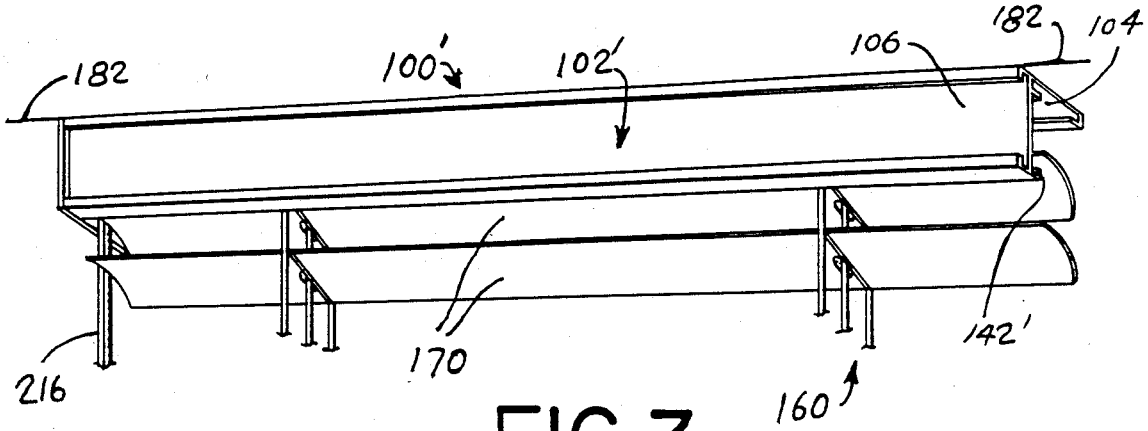
FIG. 3 is a fragmentary isometric view of an upper portion of a venetian blind according to a second embodiment of the present invention having an L-shaped head.
Figure 8:
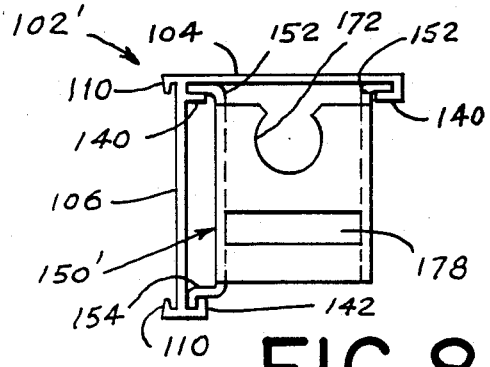
FIG. 8 is an end elevation view of the L-shaped head of the second embodiment of FIG. 3 and the cradle associated therewith.

Referring now to FIG. 3, therein illustrated is a blind 100' of the second embodiment wherein the head 102' is L-shaped (the end cap 230 being removed to reveal details of internal construction). Referring now to FIG. 8, the head 102' is identical to the head 102 of the first embodiment except for the absence of the rear side 108, its related two rear vertical flanges 112 and its one cradle-receiving rear vertical flange 142. For the purposes of this description, the upper horizontal flanges 152 are considered to be parts of the top 104 rather than parts of the sides 106, 108. Correspondingly, the cradle 150' for use in the head 102' of the second embodiment is identical to the cradle 150 of the first embodiment except that it lacks the arm 154 which would normally be received in the nip or slot 146 adjacent the rear side 108.

Figure 9:
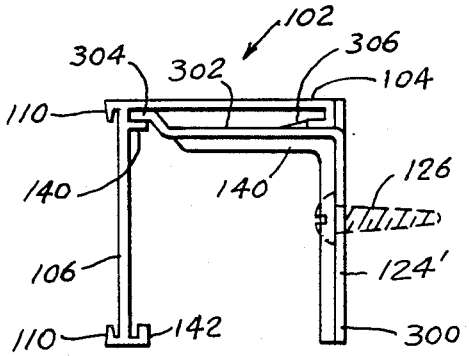
FIG. 9 is an end elevation view of the head of the second embodiment with a side installation member.
Figure 11:
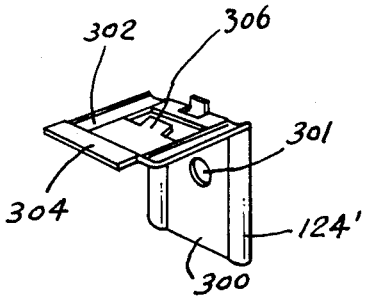
FIG. 11 is an isometric view of the side installation member shown in FIG. 9.

Referring now to FIG. 11, therein illustrated is an installation member 124' adapted for use with a blind 100' of the second embodiment, as illustrated in FIG. 9. The mounting member 124' includes a vertical portion 300 adapted to be secured to the wall or window frame by a fastener 126 extending through aperture 301 and a horizontal portion 302 having a free end 304 adapted to be received within the nip or slot 144 defined by the front upper horizontal flange 140 and the top 104. To provide additional strength, the horizontal portion 302 may be ribbed. The horizontal portion 302 further includes a cutout or tab portion 306 which is intended to be crimped or frictionally engaged with the rear upper horizontal flange 140 of the head 102' in order to fix the position of the mounting member 124' along the longitudinal axis of the head 102'. With this mounting member 124', the head top 104 may be mounted to be flush against the ceiling 182, with no gap therebetween, as shown in FIG. 3.

Figure 10:
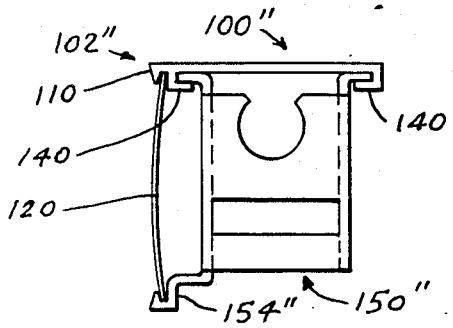
FIG. 10 is an end elevation view of the planar head of the third embodiment with a fascia shown inserted in the front side and a cradle shown mounted on the head.

Referring now to FIG. 10, therein illustrated is a blind 100'' according to the third embodiment having a head 102'' of generally planar configuration with an accompanying fascia 120 and cradle 150''. The head 102'' is identical to the head 102' of the second embodiment except for the absence of the front side 106 and its bottom front vertical flanges 110, 142. In other words, the head 102'' is terminated at the level of the upper horizontal flanges 140. The cradle 150'' is similar to the cradle 150' of the second embodiment except that the front lower arm 154'' is not used for supporting the cradle 150'', but rather to assist the head 102'' in supporting the bottom edge of the fascia 120. The planar head 102'' is mounted to the wall or window frame by means of a mounting member 124' of the type used with the second embodiment.

To use the blinds of the present invention, the mounting members 124, 124' are first secured by fasteners 126 to the wall or window frame in a number sufficient to provide adequate support for the blind. The tilt rod 176 may be inserted into the head 102, 102', 102'' either now or after insertion of the cradles 150, 150', 150'' into the head. An appropriate number of cradles 150, 150', 150'' are then positioned along the length of the head 102, 102', 102'' with the carriage arms entering the available nips or slots 144, 146, each cradle being slid along a portion of the length of the head (and possibly the length of the tilt rod 176) and carrying with it its ladder assembly 160 and its tape head 174. The end cap 200 with its tilt mechanism is applied (e.g., snap-fit) to one end of the head, while the end cap 230 with its lift cord lock mechanism is applied to the other end of the head. In the case of the first embodiment, the head 102 is then lifted onto the top of the mounting members 124 so that the free end 128 of the vertical portion of the mounting member is received in the upper nip or slot 116 and the bottom of the rear head side 108 rests on the horizontal portion 130 of the mounting member 124. (In the case of the second and third embodiments, the free end 304 of the horizontal portion 302 of the mounting member 124' is inserted into the upper front nip 144). The tabs or cutouts 132, 306 are then displaced to lock the head on the mounting member. (If desired, mounting of the end caps 200, 230 on the ends of the head may be delayed until this point.) The fascia 120 is then mounted on the head.

Finally, the tapes 162, 164 and cords 180 are secured to the bottom rail 250 using an internal clip 260 or an external clip 260', and the bottom rail is covered with an adjacent slat 170 on top and a conventional bottom rail end cap 50 on each end.

To summarize, the present invention provides a venetian blind in which the head and bottom rail require no aperture-forming operations, thereby reducing greatly the cost of the manufacture of the blind.

Now that the preferred embodiments of the present invention have been shown and described in detail, various modifications and improvements thereon will become readily apparent to those skilled in the art. Accordingly, the appended claims should be interpreted broadly in a manner consistent with the spirit and scope of the present invention.

I claim:

1. In a venetian blind having a plurality of slats including a vertically movable bottom rail, a head, means for mounting said head on a support, means provided in said head for suspending said slats from said head, means provided in said head for lifting and lowering said slats, and means provided in said head for tilting said slats from essentially horizontal positions to tilted positions and vice-versa; the improvement comprising said head having a top and the absence of a bottom intermediate said top and said slats, said head being entirely imperforate.

2. The venetian blind of claim 1 wherein said top of said head is planar.

3. The venetian blind of claim 1 wherein said head includes at least one side depending from said top.

4. The venetian blind of claim 3 wherein said head is inverted U-shaped and includes said top and a horizontally spaced pair of said sides said top connecting said sides.

5. The venetian blind of claim 3 wherein said head is L-shaped and includes said top and only a single one of said sides.

6. The venetian blind of claim 1 including at each end of said head an end cap mounted on said head end.

7. The venetian blind of claim 6 wherein said lifting and lowering means and said tilting means are at least partially disposed within respective ones of said end caps.

8. The venetian blind of claim 6 wherein said end caps are removably snap-fit into said head.

9. The venetian blind of claim 6 additionally including first means for actuating said lifting and lowering means and second means for actuating said tilting means, said first and second actuating means being disposed at least partially without said head.

10. The venetian blind of claim 9 wherein said first and second means are disposed partially within said end caps.

11. The venetian blind of claim 1 including a plurality of cradles disposed within said head and wherein said suspending means, said lifting and lowering means, and said tilting means are each secured to at least one of said cradles.

12. The venetian blind of claim 11 wherein said suspending means, said lifting and lowering means, and said tilting means are each at least partially disposed in cradles intermediate said top of said head and said plurality of slats.

13. The venetian blind of claim 11 wherein said cradles are originally slidable into said head and operationally connects said head with said suspending means, said lifting and lowering means, and said tilting means.

14. The venetian blind of claim 1 wherein said head is configured and dimensioned to receive therein at least an uppermost edge of the uppermost of said plurality of slats, thereby precluding any light gap intermediate said head and said plurality of slats.

15. In a venetian blind having a plurality of slats, a head, means for mounting said head on a support, means provided in said head for suspending said slats from said head, means provided in said head for lifting and lowering said slats, means provided in said head for tilting said slats from essentially horizontal positions to tilted positions and vice-versa, and a bottom rail secured to said suspending means, said lifting and lowering means and said tilting means; the improvement comprising said venetian blind additionally including a clip of unitary one-piece construction to receive and engage the bottom end of said suspending means, said lifting and lowering means, and said tilting means, said bottom rail defining an open channel which receives therein and engages said clip for movement therewith as a unit, said suspending means, said lifting and lowering means and said tilting means extending upwardly through said channel.

16. In a venetian blind having a plurality of slats, a head, means for fixedly and non-pivotably mounting said head on a support, means provided in said head for suspending said slats from said head, means provided in said head for lifting and lowering said slats, means provided in said head for titling said slats from essentially horizontal positions to tilted positions and vice-versa, and a vertically movable and non-telescopic bottom rail; the improvement comprising both said head and said bottom rail being entirely imperforate, said head having a top and the absence of a bottom intermediate said top and said slats, and clip means being provided for securing one end of said suspending means, said lifting and lowering means, and said tilting means to said bottom rial.

17. The venetian blind of claim 13 wherein said cradles act as supports for said suspending means, said lifting and lowering means, and said tilting means relative to said head.

18. The venetian blind of claim 1 wherein said mounting means fixedly and non-pivotably mounts said head on the support.

* * * * *